United States Patent [19]

Stehr

[11] Patent Number: 4,735,080

[45] Date of Patent: Apr. 5, 1988

[54] FORMING MACHINE WITH RAM-SIDE EJECTOR MECHANISM

[75] Inventor: Franz Stehr, Bergisch-Gladbach, Fed. Rep. of Germany

[73] Assignee: Eumuco Aktiengesellschaft für Maschinenbau, Leverkusen, Fed. Rep. of Germany

[21] Appl. No.: 4,921

[22] Filed: Jan. 20, 1987

[30] Foreign Application Priority Data

Jan. 22, 1986 [DE] Fed. Rep. of Germany ..... 3601809

[51] Int. Cl.[4] ..... B21K 27/00; B21D 45/04

[52] U.S. Cl. ..... 72/427; 72/345; 10/11 E; 425/422

[58] Field of Search ....., 72/345, 346, 427; 425/422, 444; 10/11 E

[56] References Cited

U.S. PATENT DOCUMENTS 3,802,013 4/1974 Nebendorf et al. ..... 10/11 E
3,927,549 12/1975 Dycke et al. ..... 72/345
4,296,625 10/1981 Weller et al. ..... 10/11 E
4,552,525 11/1985 Stehr ..... 72/427

FOREIGN PATENT DOCUMENTS 1059267 6/1959 Fed. Rep. of Germany ..... 10/11 E
2742040 4/1979 Fed. Rep. of Germany ..... 72/345
199636 11/1983 Japan ..... 72/345

*Primary Examiner*—Lowell A. Larson
*Attorney, Agent, or Firm*—Neil F. Markva

[57] ABSTRACT

A forming machine comprises an eccentric drive mechanism for executing a stroke movement of a displaceable ram mounted for movement on a machine frame. A ram-side ejector mechanism is fixed on the ram for expelling workpieces from a tool secured to the ram. The ram-side ejector mechanism includes a longitudinally displaceable ejector pin, a two-armed lever member pivotally supported by the ram and cam disks mounted on a rotatable cam shaft. The cam disks are effective to pivotally displace the lever member for causing the longitudinal displacement of the ejector pin member. The rotatable shaft carries the cam disk mounted on the displaceable ram with the lever member. A gear linkage mechanism includes a rotational transfer shaft mounted to the machine frame for driving the cam shaft in response to operation of the eccentric drive assembly. A synchronizing coupling assembly is disposed between the cam shaft and the rotational transfer shaft to effect conformal transfer of rotation of the shafts which are offset with respect to each other.

9 Claims, 4 Drawing Sheets

FORMING MACHINE WITH RAM-SIDE EJECTOR MECHANISM

FIELD OF THE INVENTION

This invention relates to a forming machine having a ram-side ejector mechanism for expelling work pieces from tools fixed on the ram. More particularly, a crank or eccentric drive executes the ram stroke movement through the use of a rotating cam disk assembly. A rotating cam disks operates a two-armed lever mechanism pivotally supported on the ram to effect longitudinal displacement of an ejector pin with respect to the ram or tool.

BACKGROUND OF THE INVENTION

A ram-side ejector mechanism shown in the German Pat. No. DE-PS 28 27 561 includes a rotating cam disk pivotally mounted on a machine frame and driven by a gear unit from the crank shaft. The angle lever actuating the ejector pin is supported on the ram executing the working or forming stroke. Constant displacement of the centers of rotation of the angle lever and the cam disk results from the stroke movement of the ram in this known assembly. Thus, an extended cam disk, with which the curve execution, according to the path-time law, for the ejecting movement is taken into account to balance the displacement of the centers of rotation as a result of the ram stroke.

This configuration results in a transfer of the deteriorating transfer angle known from gear technology and the disadvantages resulting therefrom. Such a known ejector mechanism cannot be used on forming machines with ram adjustment because the basic positions of the bearing distances of the angle lever on the ram and on the cam disk on the machine frame alter or change with respect to each other when the ram is adjusted. This results in an alteration of the actuation of the ejector according to the path-time law.

Furthermore, a known ram-side ejector mechanism has an expelling movement effected by a rotating cam disk which is supported together with the angle lever on the ram. The driving mechanism for the cam disk is also situated on the ram executing the stroke. A coupling rod is disposed between the crank or eccentric drive for the ram and the gear unit for the cam disk arranged in a parallel fashion to this drive.

This prior art construction is very expensive and, with the same rotational direction as the main drive, causes additional inertial forces, which results in an uneven operation particularly at high stroke frequencies. Such a known ejector system cannot be used on machines with ram adjustment without an alteration of the path-time law for the ejector, as with ram adjustment, the drive system for the ejector connected in parallel is displaced opposite the machine drive. The coupling rod adopts with this a sloping position which results in rotation of the ejector drive opposite the press drive and this produces a phase displacement for the ejector stroke.

SUMMARY OF THE INVENTION

The primary object of the invention is to provide a ram-side ejector mechanism for an eccentrically driven forming machine having a ram adjustment which must satisfy a predetermined path-time law which is not altered even in the case of differing ram positions for automated transverse transport of work pieces from the working zone.

The ram-side ejector mechanism of the invention has a cam disk and two-armed lever supported on the ram which executes the stroke. A synchronizing coupler assembly is located between the shaft carrying the cam disks and a gear linkage mechanism driving the cam disk in response to operation of the crank or eccentric drive assembly. The synchronizing coupler assembly includes a conformal transfer for parallel shafts one of which carrys the cam disk and the other is a rotational transfer shaft. The parallel shafts lie in an offset manner with respect to each other.

The synchronizing coupler assembly is fixedly supported in a stationary position on the machine frame between the gear linkage mechanism and the shaft for the cam disk. The cam disk shaft moves with the ram stroke and makes an expelling apparatus possible and can work unchanging in each function given by resetting even when a ram stroke position adjustment, similarly present, is actuated. The ejector mechanism assembly is continuously adjustable and functions in accordance with exactly run path-time laws.

Alteration of the stroke position setting of the ram moved by the main eccentric drive of the forming machine has no side-effects for the drive of the cam arranged on the ram and, thus, moved by the ram. In this way, even with differing ram adjustments, a variance of the given path-time law for the expelling movement does not exist.

According to a further feature of the invention, the gear linkage assembly for driving the cam disk from the eccentric ram drive includes two bevel gears connected at each end of a shaft. One bevel gear is arranged on the eccentric ram drive shaft and another bevel gear is disposed on the input shaft of the synchronizing coupler assembly. The input shaft of the synchronising coupler assembly is rotatable in a mounting fixed to the machine frame.

On forming machines having several forming stations, a cam disk is assigned to each forming station and provides movement to a two-armed lever operating an ejector stroke length to move an ejector pin.

Another feature of the invention is directed to the specific configuration of a synchronizing coupler assembly which includes two parallel shafts offset with respect to each other with each shaft having a disk member fixedly connected thereto. A third disk is disposed between the two disks and pivotally connected to each of the other disks fixed to the respective offset shafts. At least three guide rods connect the center disk to each of the other disks. The guide rods are pivotally mounted at each end thereof on pins fixedly disposed on the disks. Here the spacing of the offset shafts can alter while in operation and under load in accordance with the stroke of the ram and a possible stroke position adjustment.

BRIEF DESCRIPTION OF DRAWINGS

Other objects of this invention will appear in the following description and claims, reference being made to the accompanying drawings forming a part of the specification wherein like reference characters designate corresponding parts in the several views.

DETAILED DESCRIPTION

Figure 1:
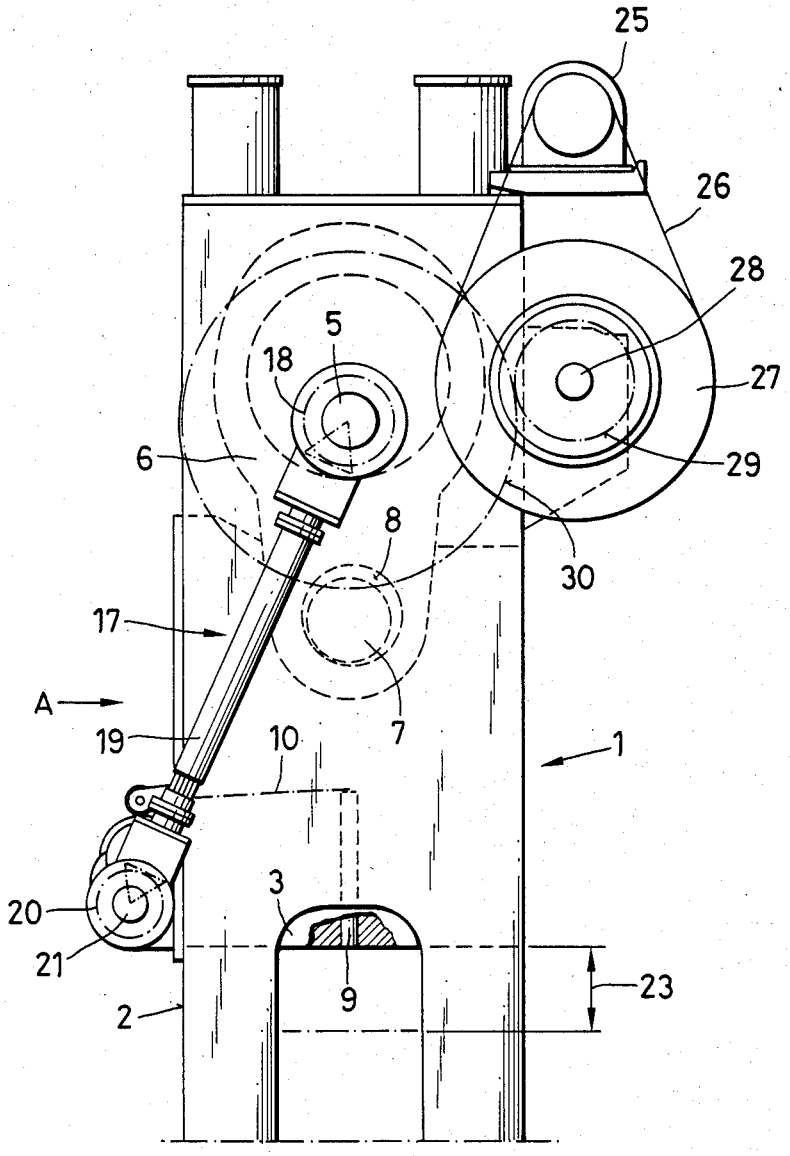
FIGS. 1 and 1A are partial side elevational views of an ejector drive mechanism for a forming machine made in accordance with this invention.

The eccentric press forming machine, generally designated 1, includes a ram-side ejector mechanism having a machine frame 2 in which a ram 3 is mounted to move up and down in guideways 4. The drive mechanism includes an eccentric shaft 5 and two connecting rods 6 which interact with ram 3 via bearing pin 7. Axle bearing pin 7 includes two eccentrics 8 actively connected to connecting rods 6 to effect adjustment of the stroke position of ram 3. That is, when the axle pin 7 is twisted with respect to the eccentrics 8, the stroke position of ram 3 is thereby adjusted.

An ejector pin 9 is slidingly mounted in ram 3 and can be actuated by a two-armed lever 10 pivotally supported in ram 3 by axle 12. A cam follower 16 at one end of lever 10 is in rolling contact with a cam disk 11. A common shaft 13 bears a cam disk 11 for each of the ejector pins 9 found in ram 3. Bearing blocks 14, 14*a*, 14*b* are fixed to ram 3 and hold cam disks 11 in place on common shaft 13.

A spring 15 ensures contact between each cam disk 11 and cam follower roller 16 rotatably supported on each lever 10. Motor 25 drives fly-wheel 27 with transfer element (belt) 26 about shaft 28 and a pair of gear wheels 29 and 30. Gear wheel 30 is fixedly mounted to eccentric shaft 5 and is thereby rotated upon rotation of gear wheel 30.

A gear linkage assembly 17 leads off from the drive shaft 5 and serves as the drive for cam disks 11. Bevel gear 18 is fixedly mounted on shaft 5 and transfers the drive motion for the cam disk 11 via shaft 19 onto rotational transfer shaft 21 via bevel gear 20. Disposed in housing 22 which is secured to machine frame 2. Rotational transfer shaft 21 is parallel to cam shaft 13 which carries cam disks 11. Thus, shaft 13 and cam disks 11 move up and down with ram 3 over a stroke length 23 while shafts 21 and 13 rotate through the rotational action of linkage shaft 19.

Figure 6:
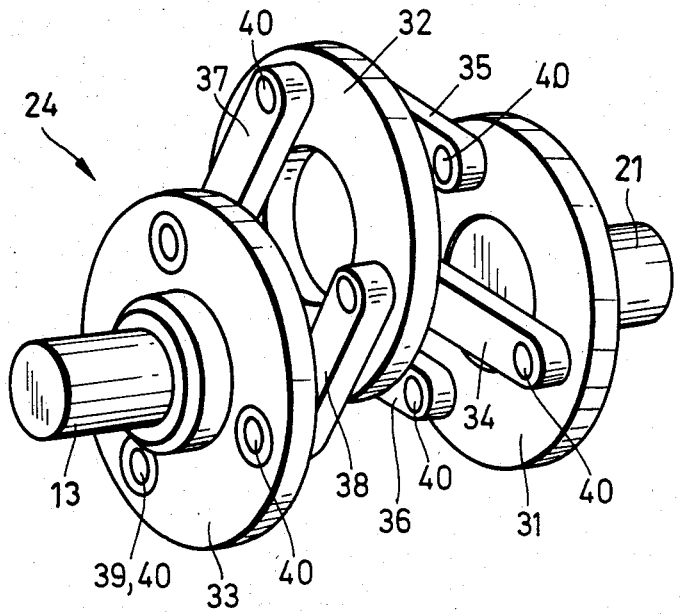
FIG. 6 is a perspective view of the synchronizing coupler assembly made in accordance with the invention.
Figure 1A:
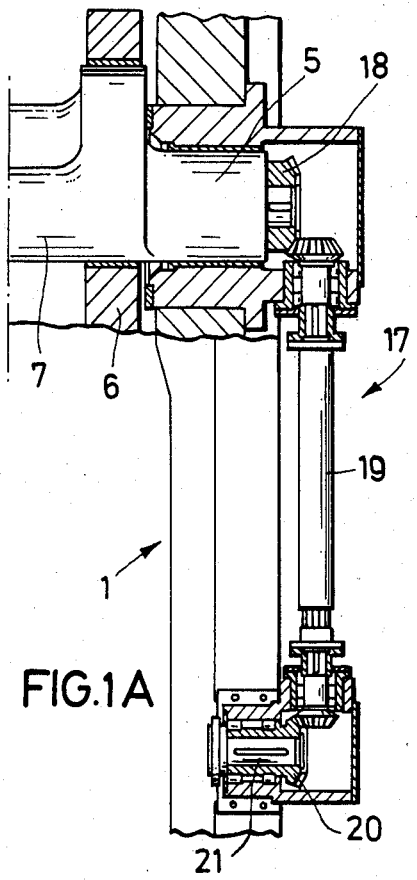
Figure 2:
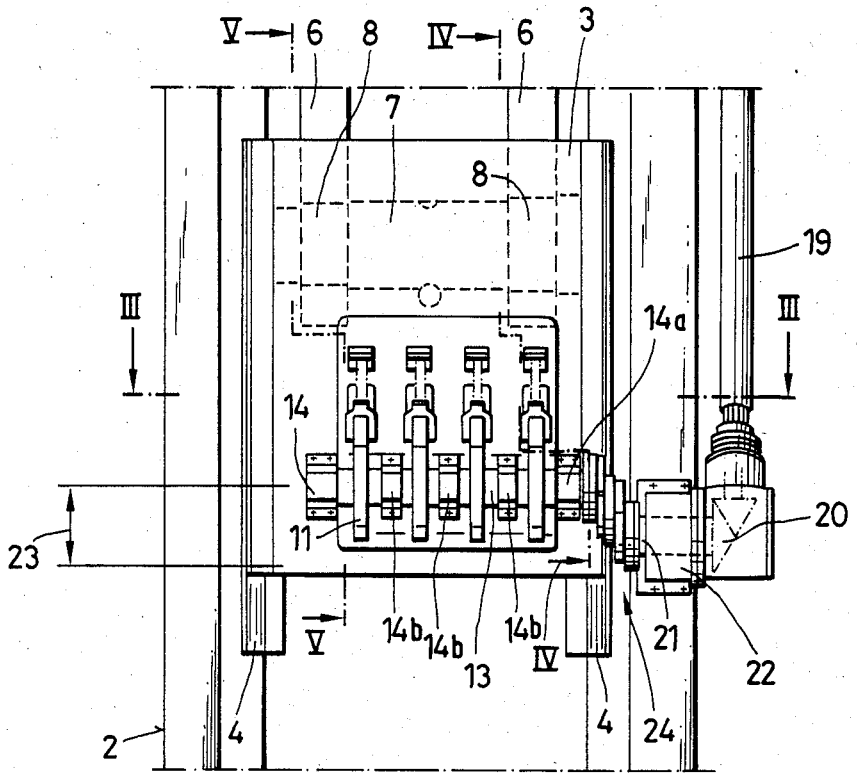
FIG. 2 is a partial elevational view of the ejector mechanism in the direction of arrow A of FIG. 1.
Figure 3:
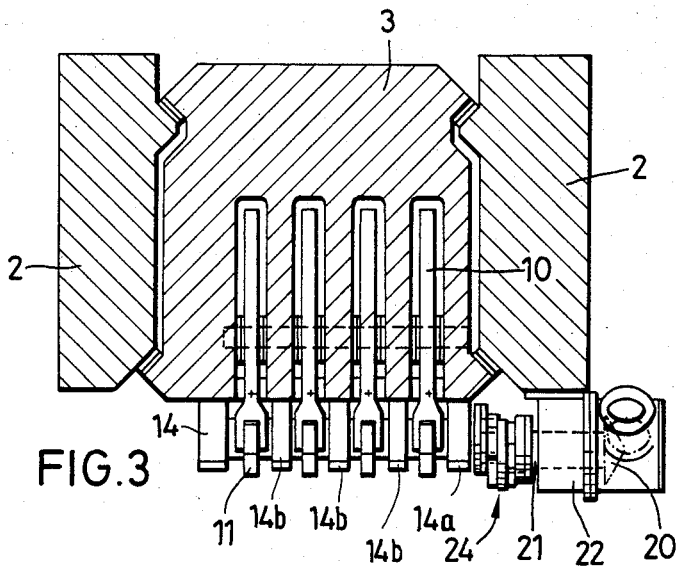
FIG. 3 is a sectional view along line III—III of FIG. 2.
Figure 4:
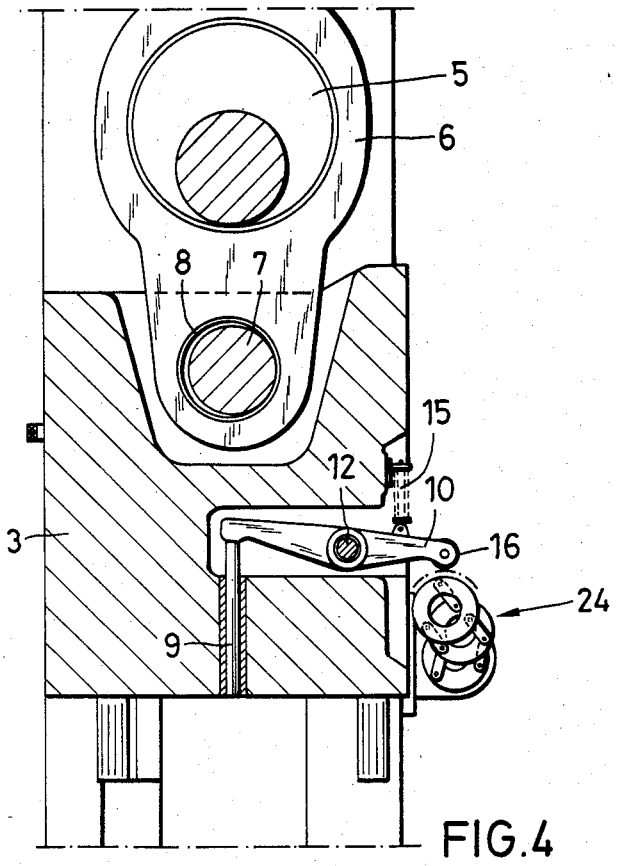
FIG. 4 is a sectional view along line IV—IV of FIG. 2 showing the synchronizing coupler assembly according to the invention.
Figure 5:
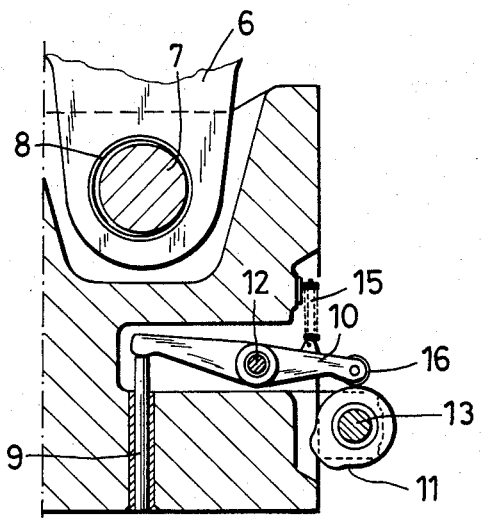
FIG. 5 is a sectional view along line V—V of FIG. 2 showing the cam disk assembly according to the invention.

Drive shafts 13 and 21 lie in an offset manner with respect to each other and are joined together with a coupler mechanism 24 which effects the transfer of rotation from shaft 21 to parallel shaft 13. The distance between shafts 13 and 21 is constantly changing because of the movement of ram 3. Coupler mechanism 24 is a synchronizing coupler assembly and composed of three disks 31, 32, and 33 connected to each other by guide rods 34, 35, 36, and 37, 38, 39 disposed between each two disks 31, 32, and 32, 33. The guide rods 34, 35, 36, and 37, 38, 39 are pivotally mounted on pins 40 fixedly secured to each of the disks 31, 32, and 33 as shown in FIG. 6.

Pins 40 are fixedly secured in each of said disks when the rotation of any disk is uniformly transferred onto the next disk by the connecting guide rods. Middle disk 32 serves as a balancing element. That is, disk 32 swings out to the offset of shafts 13 and 21 in a correspondingly perpendicular manner. Such a synchronizing coupler mechanism is known. In such a coupler mechanism, only torque is transferred so that forces of reaction do not affect the shaft bearing. An alteration of the angular speed does not occur even when the offset of shafts 13 and 21 is altered with respect to one another.

The synchronizing coupler mechanism 24 is fixedly secured to frame 2 in a stationary position between the rotational transfer shaft 21 and cam shaft 13 which moves with ram 3 thereby carrying the cam disks 11 up and down. With such an arrangement, the movement of expeller or ejector pins 9 are strictly maintained in accordance with the given path-time law. Even with differing ram positions as a result of a changed angle position of angle pin 7 with eccentrics 8 of ram 3. The additional offset resulting from the stroke position adjustment does not affect the rotation of cam disks 11. Such additional offset is absorbed by the synchronizing assembly 24 because the coupler assembly assimilates a differing offset of shafts 13 and 21 without the angular speeds of the shafts being altered with respect to each other.

While the forming machine with ram-side ejector mechanism has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A forming machine comprising:
   (a) eccentric drive means for executing a stroke movement of a displaceable ram mounted for movement on a machine frame,
   (b) a ram-side ejector mechanism fixed on the ram for expelling workpieces from a tool secured to the ram,
   (c) said ram-side ejector mechanism including a longitudinally displaceable ejector pin member, a two-armed lever member pivotally supported by the ram and cam means mounted on a rotatable cam shaft,
   (d) said cam means being effective to pivotally displace the lever member for causing the longitudinal displacement of the ejector pin member,
   (e) said rotatable shaft carrying said cam means being mounted on the displaceable ram with the lever member,
   (f) gear linkage means including a rotational transfer shaft mounted to the machine frame for driving said cam shaft in response to operation of said eccentric drive means, and
   (g) synchronizing coupling means disposed between the cam shaft and the rotational transfer shaft to effect conformal transfer of rotation of said shafts which are offset with respect to each other.

2. A forming machine as defined in claim 1 wherein said cam shaft and said rotational transfer shaft are parallel with respect to each other.

3. A forming machine as defined in claim 1 wherein the gear linkage means includes a rotatably mounted linkage shaft, first means disposed at one end thereof for rotating said linkage shaft in response to the rotation of said eccentric drive means and second means disposed at the other end of the linkage shaft for rotating said rotational transfer shaft.

4. A forming machine as defined in claim 3 wherein the first rotating means includes first gear means mounted to rotate said linkage shaft in response to the rotation of the eccentric drive means, and the second rotating means includes second gear means mounted to rotate the rotational transfer shaft upon rotation of said linkage shaft.

5. A forming machine as defined in claim 4 wherein said first gear means includes bevel gears mounted to rotate the linkage shaft upon rotation of a supporting shaft for the eccentric drive means, and said second gear means includes bevel gears mounted to transfer rotation of the linkage shaft to the rotational transfer shaft.

6. A forming machine as defined in claim 1 wherein said synchronizing coupling means includes a first disk member fixedly secured to the cam shaft, a second disk member fixedly connected to the rotational transfer shaft and a third disk member disposed between and pivotally connected to the first and second disk members, and pivotally connected thereto with a plurality of guide rod members.

7. A forming machine as defined in claim 6 wherein a plurality of guide rod members pivotally connect the third disk member to the first and second disk members, said cam shaft and said rotational transfer shaft being parallel with respect to each other.

8. A forming machine as defined in claim 7 wherein said guide rod members are pivotally mounted at one end to pins fixed on the third disk member and pivotally mounted on the other end thereof respective pins fixedly secured to said first and second disk members.

9. A forming machine as defined in claim 1 wherein there are a plurality of tool locations in the ram with an ejector pin member for each tool location, and the cam shaft carries a plurality of cam disks corresponding to each of the ejector pins.

* * * * *